US008011524B2

(12) United States Patent
Perry et al.

(10) Patent No.: US 8,011,524 B2
(45) Date of Patent: Sep. 6, 2011

(54) MICROWAVEABLE PACKAGED GOOD ARTICLE OVERCAP

(75) Inventors: Michael R. Perry, Plymouth, MN (US); Arne H. Bradner, Hopkins, MN (US); Glenn M. Larche, Malvern, PA (US)

(73) Assignee: General Mills Cereals, LLC, Minneapolis, MN (US)

( * ) Notice: Subject to any disclaimer, the term of this patent is extended or adjusted under 35 U.S.C. 154(b) by 1246 days.

(21) Appl. No.: 11/261,110

(22) Filed: Oct. 28, 2005

(65) Prior Publication Data

US 2006/0091140 A1 May 4, 2006

Related U.S. Application Data

(60) Provisional application No. 60/622,892, filed on Oct. 28, 2004.

(51) Int. Cl.
*B65D 51/20* (2006.01)

(52) U.S. Cl. ..... 220/258.2; 220/780; 220/367.1; 220/256.1

(58) Field of Classification Search ..... 220/258.2, 220/780, 781, 380, 367.1, 359.2, 256.1, 258.3; 206/508

See application file for complete search history.

(56) References Cited

U.S. PATENT DOCUMENTS

| | | | | |
|---|---|---|---|---|
| 2,533,159 | A | | 10/1948 | Yates |
| 3,411,660 | A | | 11/1968 | LaFarge |
| 3,572,413 | A | | 3/1971 | Livingstone |
| 3,670,951 | A | | 6/1972 | Smith |
| 3,721,365 | A | | 3/1973 | Saunders |
| 3,741,431 | A | | 6/1973 | Burdick |
| 3,753,512 | A | | 8/1973 | Curry |
| 3,809,284 | A | | 5/1974 | Churan |
| 3,883,036 | A | | 5/1975 | Mahaffy |
| 3,904,072 | A | | 9/1975 | Whiteside |
| 3,995,766 | A | | 12/1976 | Fralick |
| 4,006,837 | A | | 2/1977 | Gates |
| 4,027,776 | A | | 6/1977 | Douglas |
| 4,079,857 | A | * | 3/1978 | Crisci ..... 206/508 |
| 4,187,953 | A | | 2/1980 | Turner |
| 4,201,311 | A | | 5/1980 | Underwood |
| 4,380,305 | A | | 4/1983 | Von Holdt |
| 4,399,926 | A | | 8/1983 | Eidels-Dubovoy |
| 4,407,426 | A | * | 10/1983 | McLaren et al. ..... 220/781 |
| 4,418,832 | A | | 12/1983 | Schneider |
| 4,421,244 | A | | 12/1983 | Van Melle |
| 4,520,943 | A | | 6/1985 | Nielsen |
| 4,535,905 | A | | 8/1985 | Sandhaus |
| 4,709,832 | A | | 12/1987 | Mantyla |
| 4,723,676 | A | | 2/1988 | Kobayashi |
| 4,756,443 | A | | 7/1988 | Murayama |
| 4,793,510 | A | | 12/1988 | Arfert |
| 4,846,366 | A | | 7/1989 | Satz |

(Continued)

*Primary Examiner* — Anthony Stashick
*Assistant Examiner* — Christopher B McKinley
(74) *Attorney, Agent, or Firm* — Timothy A. Czaja; Douglas J. Taylor; Annette M. Frawley

(57) ABSTRACT

A microwaveable packaged good article is described. The microwaveable packaged good article includes a container and an overcap. The container includes a base and a continuous wall extending from the base terminating in a chime. The overcap includes a panel, a neck extending from the panel terminating in a drip bead, and a skirt radially spaced from the drip bead to define a channel between the skirt and the drip bead. In this regard, the chime is received within the channel upon assembly of the overcap to the container.

20 Claims, 7 Drawing Sheets

U.S. PATENT DOCUMENTS 4,886,184 A * 12/1989 Chamourian ..... 220/781
4,923,085 A 5/1990 Lillelund
5,094,706 A * 3/1992 Howe ..... 156/214
D345,081 S * 3/1994 Adami et al. ..... D7/391
5,390,810 A 2/1995 Stroble
5,411,160 A 5/1995 Goulet
5,411,161 A 5/1995 Fish, Jr.
5,452,818 A 9/1995 Yost
5,538,154 A 7/1996 Von Holdt
5,582,317 A 12/1996 Wermund
5,680,952 A 10/1997 Chasten
5,725,123 A 3/1998 Otto-Nagels
6,015,061 A 1/2000 Lowry
6,056,144 A 5/2000 Strange
6,056,145 A 5/2000 Rush
6,164,484 A 12/2000 Fiore
6,168,044 B1 1/2001 Zettle
6,220,471 B1 4/2001 Lowry
6,260,729 B1 7/2001 Mitchell
6,685,049 B1 * 2/2004 Paladino ..... 220/781
6,688,487 B2 2/2004 Oakes
6,729,491 B2 5/2004 Morris
6,851,569 B2 2/2005 Conti
6,860,397 B1 3/2005 Walters, Jr.
7,112,771 B2 * 9/2006 Richardson et al. ..... 219/725
2002/0148846 A1 * 10/2002 Luburic ..... 220/792
2003/0015542 A1 1/2003 Nulty
2003/0085228 A1 5/2003 Oakes
2003/0222083 A1 * 12/2003 Pladsbjerg ..... 220/254.3
2003/0222084 A1 12/2003 Morris, Jr.
2004/0011803 A1 1/2004 D'Amato
2004/0094553 A1 5/2004 Crider
2004/0206765 A1 10/2004 McMahon, III
2004/0262309 A1 12/2004 Edwards
2005/0061815 A1 * 3/2005 Wong ..... 220/281
2005/0145627 A1 * 7/2005 Stull et al. ..... 220/254.3
2006/0032857 A1 * 2/2006 Stensbol et al. ..... 220/780

* cited by examiner

MICROWAVEABLE PACKAGED GOOD ARTICLE OVERCAP

CROSS-REFERENCE TO RELATED APPLICATIONS

This application claims priority to and the benefit of Provisional Patent Application No. 60/622,892, filed on Oct. 28, 2004, and entitled "Microwaveable Packaged Good Article Overcap", the teachings of which are incorporated herein by reference in its entirety.

BACKGROUND

The present invention relates to a microwaveable packaged good article, and more particularly, it relates to an overcap for a microwaveable packaged good article.

Consumers have responded favorably to a variety of packaged foods provided as microwaveable packaged good articles. In particular, consumers have shown a strong preference for ready-to-eat packaged good articles that can be quickly and conveniently heated in a microwave oven. Some particularly popular packaged good articles include lunch or dinner entrees such as soups, chilies, stews, and pasta meals (e.g., spaghetti and ravioli) provided in sealed containers that are suitable for microwave heating.

In general, a microwaveable packaged good article includes a container containing a consumable item, an optional removable lid to sealingly preserve the consumable item within the container prior to preparation/consumption, and an overcap. To prepare the consumable item, the consumer typically first removes the overcap from the container for access to the removable lid. The removable lid is then separated from the container to expose the consumable item within the container. The overcap is then replaced on the container to form a covered cooking vessel. In this manner, the assembled container/overcap is readied for subsequent microwave heating of the consumable item.

During microwave heating, the consumable item is preferably heated to its boiling point. When the consumable item boils, steam is generated. In this regard, the overcap typically includes at least one vent to permit an equalization of pressure within the container. That is to say, the heated steam exits the container through the vent to alleviate a build-up of pressure inside the container. Boiling of the consumable item inevitably results in bubbling or splashing within the container, resulting in liquid accumulation along an inside surface of the overcap. Frequently, the bubbling/splashing consumable item will seep between the overcap and a lip of the container, dripping or flowing onto an exterior of the container.

For example, one known overcap for a microwaveable packaged good article includes a top panel provided with vent holes and a skirt descending from the top panel. A series of spaced reinforcing ribs is provided on the interior of the overcap, extending between an interior surface of the top panel and an interior side of the skirt. Upon final assembly, the ribs rest against a top of the container, with a portion of the skirt extending along an exterior of the container. Unfortunately, during microwave heating, the boiling consumable item within the container can accumulate between the reinforcing ribs and subsequently seep or drip between the skirt and the exterior of the container. These drips are unsightly, may soil the microwave (or other surface that the container is subsequently placed on), and may lead to user handling inconveniences.

In addition, the known overcap can deform when a large axial force is applied to the top panel. For example, during distribution and merchandising, several packaged good articles are commonly stacked vertically one on top of another. To this end, mass distribution normally entails grouping a number of individual packaged good articles within a tray or box, and then stacking multiple ones of the so-formed trays on a pallet. In this manner, a large axial loading is directed onto the top panel of the bottommost packaged good article present on a distributor's pallet or even a merchant's shelf.

By way of reference, the skirt/ribs of the known microwaveable container overcap are sized to position the top panel well above a top portion of the container to ensure adequate spacing during boiling. Thus, the overcap is supported relative to the container primarily by the ribs, which in turn are supported by the skirt. In the presence of axial loadings of greater than forty pounds, the known overcap exhibits structural failure in the form of the ribs deflecting or deforming, leading to non-reversible deformation of the skirt. These deformations create an unattractive merchandizing unit at the point of sale, reduce viability of the overcap during subsequent microwave heating and have the potential to damage the contained item by rupturing the removable lid. In any regard, the known overcap insufficiently resists deformation from axial loadings that are oftentimes encountered during normal distribution and merchandizing.

Consumers continue to show strong demand for microwaveable packaged good articles. Unfortunately, the standard overcap for microwaveable packaged good articles can lead to the boiling consumable item exiting the container and soiling the container's exterior and/or inside of the microwave. In addition, the known overcap employed with microwaveable packaged good articles can radially deform under common distribution and merchandizing loads, thus threatening the integrity of the packaged good article. Therefore, a need exists for an overcap for a microwaveable packaged good article that resists radial deformation and prevents boiling contents from exiting the container.

SUMMARY

Some aspects in accordance with principles of the present invention relate to a microwaveable packaged good article. The microwaveable packaged good article includes a container and an overcap. The container includes a base and a continuous wall extending from the base terminating in a chime. The overcap includes a panel, a neck extending from the panel terminating in a drip bead, and a skirt radially spaced from the drip bead to define a channel between the skirt and the drip bead. In this regard, the chime is received within the channel upon assembly of the overcap to the container.

Other aspects of the present invention relate to an overcap for a microwaveable packaged good article. The overcap includes a panel, a neck extending from the panel terminating in a drip bead, and a skirt radially spaced from the drip bead to define a channel between the skirt and the drip bead.

Yet other aspects in accordance with principles of the present invention relate to a method of microwave heating a packaged good article. The method includes providing a container containing a consumable item and securing an overcap to container. In this regard, the overcap includes a panel, a neck extending from the panel terminating in a drip bead, and a skirt radially spaced from the drip bead to define a channel couplable to a chime of the container. The method further includes microwave heating the packaged good article to boil the consumable item. In doing so, portions of the boiling consumable item will accumulate along an interior of the overcap. The drip bead directs at least a portion of the accumulated consumable item back into the container.

BRIEF DESCRIPTION OF THE DRAWINGS

Embodiments of the invention are better understood with reference to the following drawings. The elements of the drawings are not necessarily to scale relative to each other. Like referenced numerals designate corresponding similar parts.

DETAILED DESCRIPTION

Figure 1:
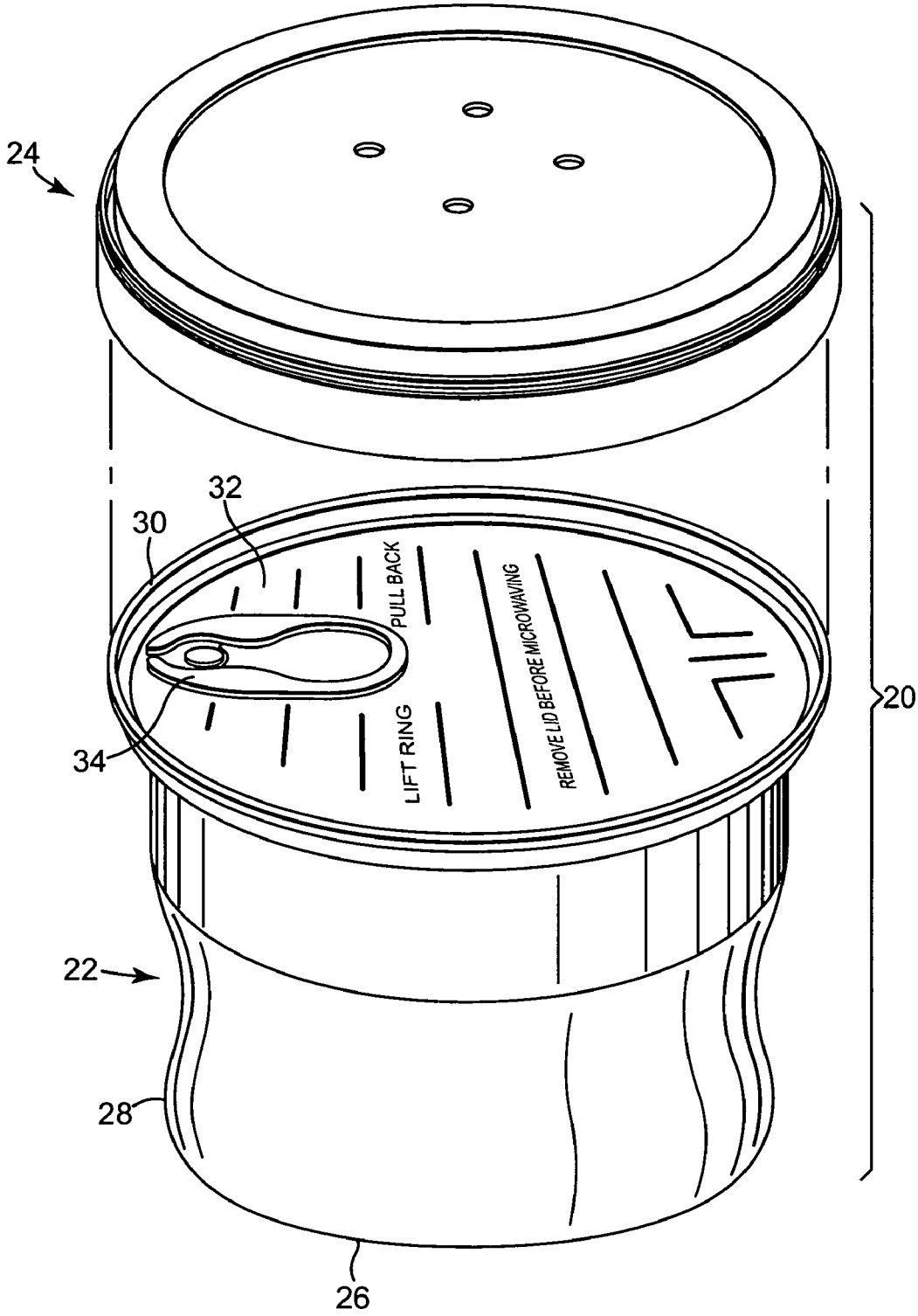
FIG. 1 is a perspective view of a microwaveable packaged good article showing a container including an optional removable lid and a displaced overcap according to aspects of the present invention.

An exemplary microwaveable packaged good article 20 according to principles of the present invention is illustrated in perspective view in FIG. 1. The microwaveable packaged good article 20 includes a container 22 and an overcap 24. As described more fully below, the overcap 24 is configured to couple to the container 22 to permit distribution and merchandizing, and eventual microwave heating, of the packaged good article 20.

The container 22 includes a base 26 (referenced generally in FIG. 1) and a continuous wall 28 extending from the base 26 and terminating in a chime 30. The base 26 and wall 28 are integrally formed from a relatively rigid, microwaveable-material, such as molded plastic. The wall 28 can assume a wide variety of shapes differing from the one exemplary embodiment depicted in the Figures. The chime 30 is, in one embodiment, formed apart from the base 26/wall 28, and is of a highly rigid nature, such as metal (e.g., rolled aluminum). The size and shape of the chime 30 can differ from the one embodiment depicted in the Figures, as is known in the art.

In one embodiment, a removable lid 32 is removably attached to the chime 30 and includes a pull tab 34 to facilitate detaching the removable lid 32 from the chime 30. However, it should be understood that other mechanisms and methods for removing the removable lid 32 from the chime 30 are equally acceptable. The chime 30/lid 32 construction is, in one embodiment, in accordance with conventional designs in which the chime 30/lid 32 is simultaneously formed from metal and provided with a score-line (or partial cut) to facilitate separation of the lid 32 from the chime 30 by a user. Alternately, the lid 32 can be eliminated. As a point of reference, when the container 22 has the lid 32 attached, the container 22 and the lid 32 combine as shown to form a full panel, easy-open container.

Figure 2:
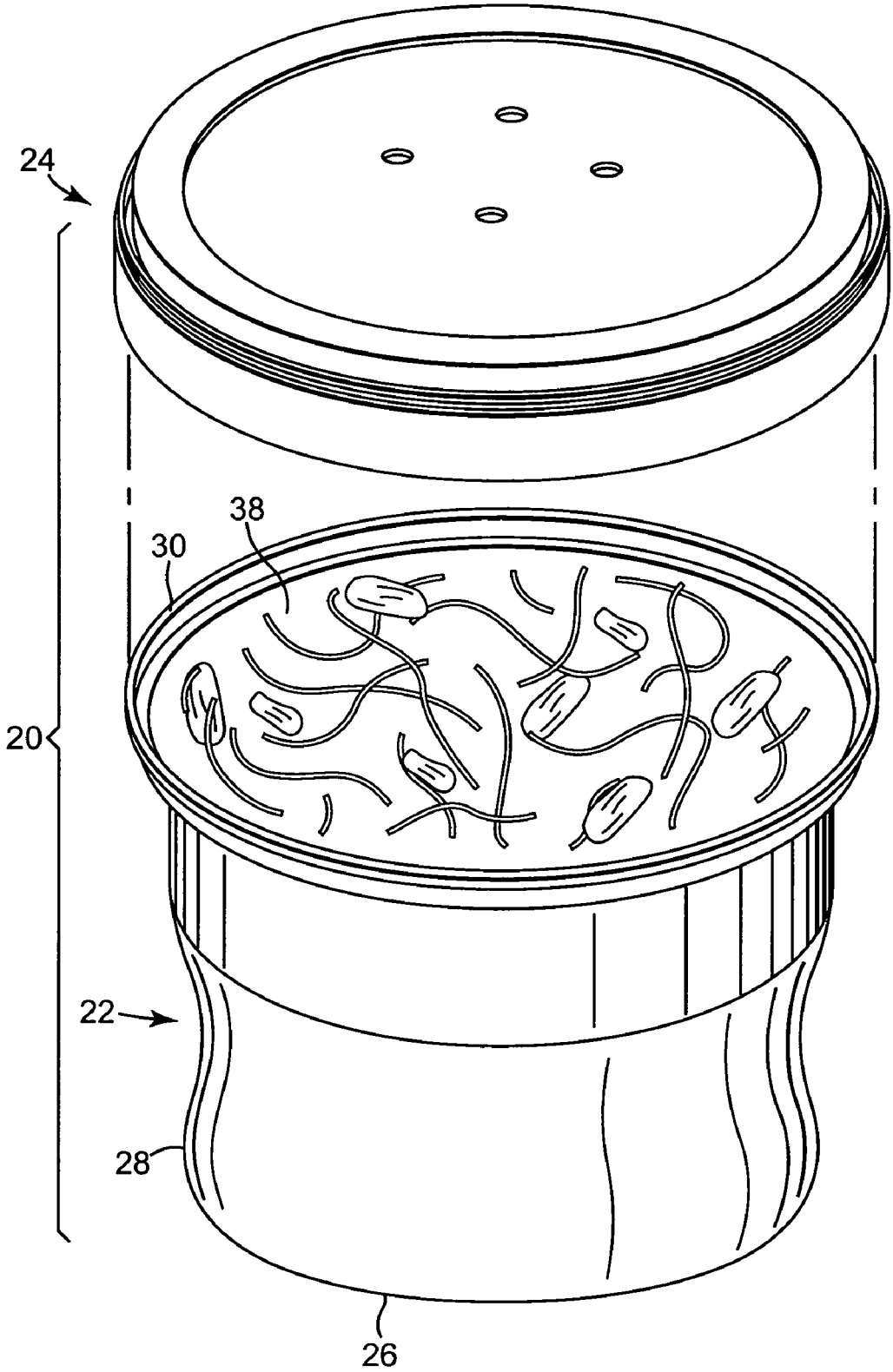
FIG. 2 is a perspective view of the microwaveable packaged good article of FIG. 1 showing the removable lid removed from the container.

FIG. 2 illustrates the microwaveable packaged good article 20 including a consumable item 38 within the container 22 and the overcap 24 poised for attachment to the container 22 prior to microwave heating (or following disassembly of the overcap 24 after microwave heating). In general, the consumable item 38 will have a sufficient amount of moisture to facilitate microwave heating. However, it is also recognized that consumers will occasionally add liquid (e.g., water) to the consumable item 38 as a preference, or in following cooking instructions. Examples of acceptable consumable items 38 useful with the packaged good article 20 of the present invention include soup (dry or liquid) having various ingredients such as pasta, beans, meat, and/or vegetables; chili; stew; pasta meals (e.g., spaghetti, ravioli, etc.); pork-and-beans; etc., to name but a few. In any regard, the consumable item 38 can fill the container 22 up to the level of the chime 30 (although the level is typically below the chime 30 to avoid accidental spilling when handling the container 22), and can be microwave heated to the point of boiling.

Figure 3A:
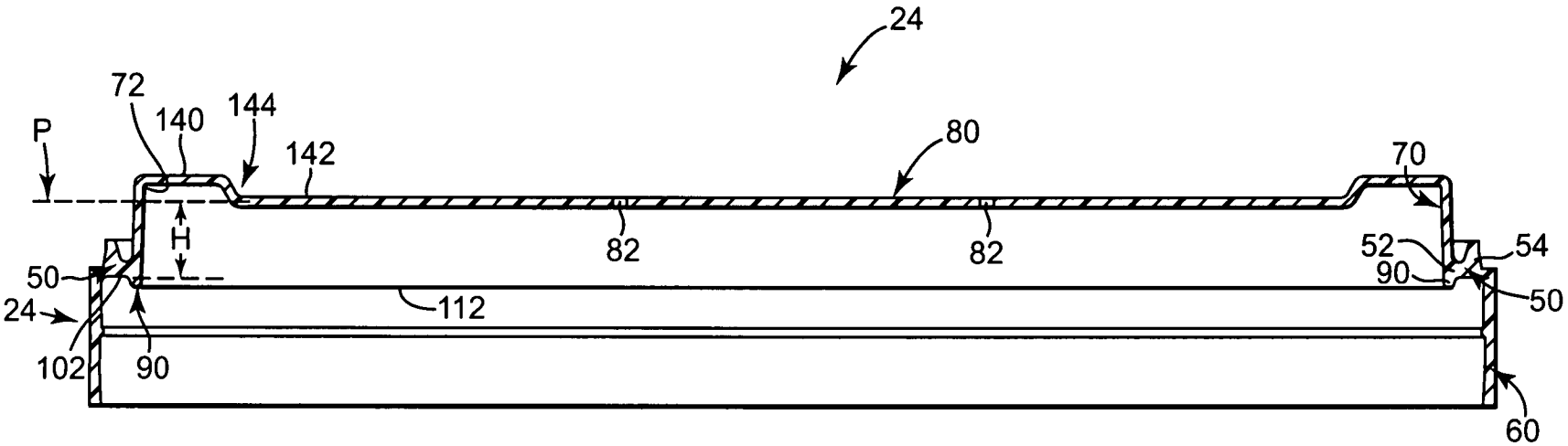
FIG. 3A is a cross-sectional view of the overcap shown in FIG. 2.

One embodiment of the overcap 24 is shown in greater detail in FIG. 3A. The overcap 24 includes or integrally forms a shoulder 50, a skirt 60, a neck 70, a panel 80, and a drip bead 90. Details on the various components are provided below. In general terms, however, the neck 70 extends from the panel 80, terminating in the drip bead 90 longitudinally opposite the shoulder 50. The skirt 60, in turn, extends from the shoulder 50. In this regard, the skirt 60 is radially spaced from the drip bead 90 by the shoulder 50. More particularly, in one embodiment the shoulder 50 includes a transition segment 52 and a rib structure 54. Relative to the upright orientation of FIG. 3A, the skirt 60 descends from the rib structure 54. Conversely, a first portion of the neck 70 ascends from the transition segment 52 and generally defines a top portion 72 that is connected to (or integrally formed with) the panel 80. In addition, a second portion of the neck 70 descends from the transition segment 52 to form the drip bead 90. It will be understood that the drip bead 90 can be described as being a component separate from the neck 70 (e.g., formed as part of the shoulder 50), or as an integral part of the neck 70. Regardless, in one embodiment, the drip bead 90 is radially offset from the skirt 60 to facilitate coupling of the overcap 24 about the chime 30 (FIG. 2), as more fully described below. As employed throughout this Specification, directional terminology such as "ascends," "descends," "top," "bottom," "front," "back," "leading," "trailing," etc., is used for purposes of illustration only and is in no way limiting. Further, while various features of the overcap 24 are described in the context of being identifiable, separate components, in some embodiments, the overcap 24 is an integral, homogenous body (e.g., molded part) such that the components can be viewed as being continuous structure(s).

The shoulder 50 can assume a variety of configurations that may or may not include one or both of the transition segments 52 and/or the rib structure 54, and/or additional structure(s). Regardless, and with specific reference to FIG. 3B, the shoulder 50 defines an interior surface 100 (referenced generally) and an exterior surface 102 (referenced generally). For example, the transition segment 52 and the rib structure 54 combine to define the interior and exterior surfaces 100, 102. With these conventions in mind, the skirt 60, the drip bead 90, and the interior surface 100 of the shoulder 50 combine to form a channel 110. In one embodiment, the channel 110 is a continuous annular channel circumscribing an outer periphery of the drip bead 90. Alternatively, the channel 110 can have a more intermittent configuration. With any of these embodiments, however, the channel 110 is sized and configured to nest about the chime 30 (FIG. 2) in forming a barrier to the passage of liquids between the overcap 24/container 22 (FIG. 2) interface.

In addition to defining a portion of the channel 110, in some embodiments the shoulder 50 is configured to enhance an overall rigidity of the overcap 24 (as compared to conventional microwaveable packaging overcaps) when assembled to the container 22 (FIG. 1). To this end, the transition segment 52 supports the neck 70 upon final assembly (with the skirt 60 is otherwise nested against the container 22), serving to limit deformation of the neck 70 in response to an axial-type force placed upon the panel 80. With this in mind, in one embodiment, the transition segment 52 has a nominal thickness of at least 0.035 inch, more preferably approximately 0.04 inch (±0.005 inch). In other embodiments described below, a thickness of the shoulder 50 at the point of intersection with the neck 70 is further increased. Thus, in some embodiments, the shoulder 50 has an increased, cross-sectional thickness as compared to known microwaveable overcap designs so as to provide structural rigidity to the overcap 24. More particularly, the shoulder 50 enables the overcap 24 to resist deformation as the microwaveable packaged good article 20 (FIG. 1) is distributed and merchandised.

The rib structure 54 provides surface adapted to facilitate stacking of one overcap 24 over another. In particular, the rib structure 54 defines a guide surface 120 that, combined with a ledge 122 defined by the skirt 60, forms a stacking feature. The stacking feature is configured such that a first overcap 24 can be stacked over and onto a second overcap 24 (such as within a magazine of an assembly apparatus) by sliding the skirt 60 of the first overcap 24 over and along the guide surface 120 and into nested contact with the ledge 122 of the second overcap 24. To this end, extension of the guide surface 120 from the ledge 122 forms a stacking angle S. It has surprisingly been found that by forming the stacking angle S to be greater than 90 degrees, ease of stacking one overcap 24 to a second overcap 24 is enhanced. In one embodiment, the stacking angle S is in the range of 90-110 degrees, more preferably approximately 100 degrees, although other angles are also acceptable. Further, in one embodiment, a height of the rib structure 54 relative to the ledge 122 is in the range of 0.04-0.10 inch, preferably 0.065-0.085 inch, more preferably approximately 0.0745 inch (although other dimensions are also acceptable). It has surprisingly been found that this one preferred height combined with the one preferred stacking angle S (described above) optimally facilitates overcap 24 stacking. Alternatively, the rib structure 54 can assume other configurations.

In addition to the ledge 122, in one embodiment, the skirt 60 forms one or more clip(s) 62 as projections from an interior skirt surface 64. The clip(s) 62 is configured to facilitate snap-fit of the overcap 24 over the chime 30 (FIG. 2) in removably securing the overcap 24 to the container 22 (FIG. 2). With this in mind, in one embodiment the clip 62 is a continuous annular band formed about an entire circumference of the interior skirt surface 64. In another embodiment, the clip 62 is formed by a plurality of discrete segments extending from the interior skirt surface 64 and forms an interrupted clip 62. In one embodiment, the interrupted clip 62 includes approximately ten discrete segments projecting from the interior skirt surface 64. Regardless, the clip(s) 62 can assume a variety of forms, and in one embodiment is defined by opposing first and second surfaces 66*a*, 66*b* that combine to define an included angle in the range of 80-100 degrees, preferably 90 degrees. Regardless, the skirt 60 is characterized by a reduced thickness immediately adjacent the second surface 66*b* (as compared to a thickness of the skirt 60 immediately adjacent the first surface 66*a*), increasing in thickness to a trailing end 68. This one configuration promotes user disassembly of the overcap 24 from the container 22 (via grasping of the skirt 60) as the skirt 60 will more readily flex in the region of decreased thickness.

As previously described, the neck 70 is formed opposite the skirt 60 and forms (or extends to) the drip bead 90. The drip bead 90 descends relative to the interior surface 100 of the shoulder 50 by a distance D. The distance D is defined as the distance between a leading end 112 of the drip bead 90 and the interior surface 100 of the shoulder 50. With this convention in mind, the drip bead 90 is offset from the skirt 60, and thus defines a height (i.e., the distance D) of the channel 110. To this end, in one embodiment the distance D is greater than 0.01 inch, preferably the distance D is greater than 0.02 inch, and more preferably the distance D is greater than 0.023 inch. For example, in one exemplary embodiment, the distance D that the drip bead 90 descends relative to the interior surface 100 of the shoulder 50 is approximately 0.0257 inch. As will be made clearer below, the distance D equates to an effective length the drip bead 90 extends within the container 22 (FIG. 2) when the overcap 24 is assembled to the chime 30 (FIG. 2). Thus, in alternative embodiments, the length of the drip bead 90 (i.e., the distance D) can be greatly increased (i.e., greater than 0.03 inch), limited only by a lateral position of the removable lid 32 (FIG. 1) or other internal container element that the drip bead 90 might otherwise contact upon assembly of the overcap 24 to the container 22. In fact, the drip bead 90 can alternatively be sized and/or shaped (e.g., varying from the shape of FIG. 3B) so as to extend to and contact a surface of the container 22 (for example, the removable lid 32 (FIG. 2)) in a manner that provides vertical support to the drip bead 90 and thus the neck 70. Regardless, the neck 70 and the drip bead 90 are preferably continuous about an entirety of the overcap 24 (e.g., formed as an annular ring) to provide a complete closure surface.

In addition to the drip bead 90, the neck 70 forms a nesting feature in one embodiment. In particular, the neck 70 defines an exterior surface 132 that extends from the shoulder 50/transition segment 52 at a nesting angle N (relative to the ledge 122 or a horizontal plane of the overcap 24 when the overcap 24 is in the upright orientation of FIG. 3B). The nesting angle N is selected to permit separation of overcaps 24, for example as one overcap 24 is removed from a magazine of stacked overcaps 24, as described above. In one embodiment, the nesting angle N is preferably only slightly greater than 90 degrees (e.g., in the range of 91-95 degrees), and more preferably, the nesting angle N is approximately 93 degrees. This slight off-set from a true 90-degree relationship (relative to horizontal) has been surprisingly found to not only facilitate desired unstacking of overcaps 24, but also enhances overall stability of the overcap 24 when assembled to the container 22 (FIG. 2). To this end, the nesting angle N represents an angular extension of the neck 70 relative to the shoulder 50, with the shoulder 50 providing primary support for the neck 70 when assembled to the chime 30 (FIG. 2) as described below. With this in mind, it has been surprisingly found that by forming the nesting angle N to approximate 90 degrees, optimum support of the neck 70 is achieved. This is in contrast to conventional overcap configurations in which the nesting angle of the neck 70 is normally on the order of 100 degrees.

Finally, and as best shown in FIG. 3A, the panel 80 is connected to or extends from the top portion 72 of the neck 70. In this manner, an overcap headspace H formed, defined as a distance between the interior surface 100 of the transition segment 52 (and thus the "top" of the channel 110) and the panel 80. With this in mind, when the overcap 24 is coupled to the container 22 (FIG. 2), the headspace H therefore also represents the distance between the chime 30 (FIG. 2) and a majority of the panel 80. The headspace H provides an expansion space for steam created when moisture in the consumable item 38 (FIG. 2) is heated, as well as a boundary region to contain boiling of the consumable item 38. To facilitate release of steam generated during microwave heating of the packaged good article 10 (FIG. 1), the panel 80 includes one or more vents 82. While four vents 82 are illustrated (as best shown in FIG. 1), it should be understood that any number of vents 82 can be formed in the panel 80 to facilitate the venting of the steam formed when heating the consumable item 38.

In one embodiment, the panel 80 includes an annular flange 140 and a central portion 142 connected to the annular flange 140. The annular flange 140 and the central portion 142 combine to form a stacking recess 144. The stacking recess 144 is configured to accept the base 26 (FIG. 1) of one of a vertically stacked packaged good article 20 (FIG. 1). In this regard, the central portion 142 is disposed in a plane P, where the plane P is offset from the annular flange 140 such that the stacking recess 144 provides resistance to a lateral movement of vertically stacked packaged good articles 20. Alternatively, the panel 80 can assume a variety of other configurations.

The overcap 24 can be constructed of any microwave-compatible material that is sufficiently stiff to thus resist buckling when one or more other packaged good articles 20 (FIG. 1) are stacked on top of the overcap 24, and flexible enough to permit the skirt 60 to be levered away from the chime 30 (FIG. 2) in removing the overcap 24 from the container 22. Exemplary materials for the overcap 24 include, but are not limited to, polymers in general, including polyolefins such as polypropylene and polyethylene, polyesters, polyamides including nylon, filled polymers, poly-coated paper, and paperboard. The overcap 24 can be formed in a variety of fashions, and in one embodiment, is an integrally molded body. Alternatively, various component(s) described above can be separately formed and subsequently assembled.

Figure 3B:
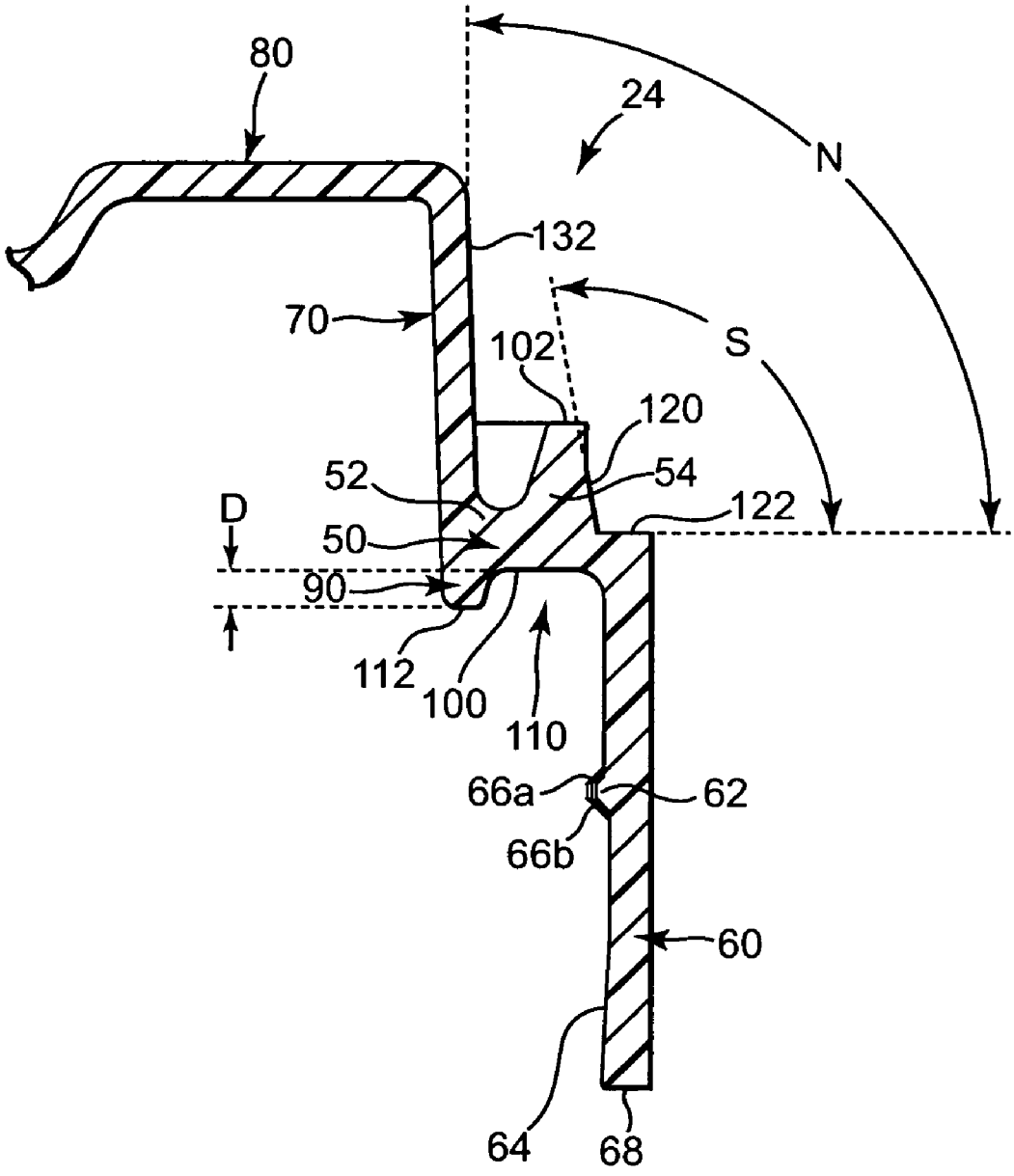
FIG. 3B is an enlarged view of a portion of FIG. 3A.
Figure 4:
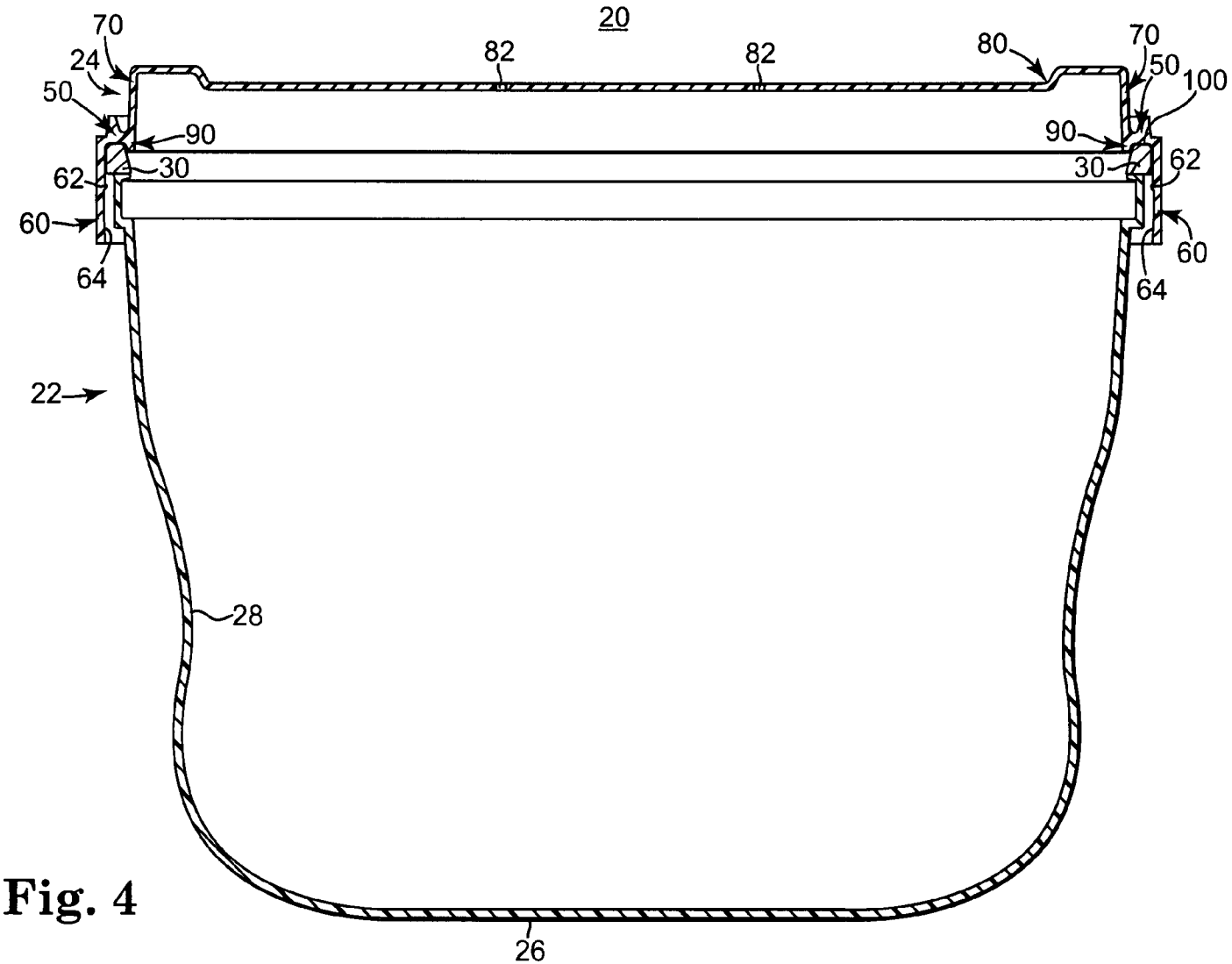
FIG. 4 is a cross-sectional view of the overcap of FIG. 3A assembled to the container.

FIG. 4 illustrates a central cross-section of the overcap 24 coupled to the container 22. Once again, the container wall 28 terminates in the chime 30 that may or may not be connected to the removable lid 32 (FIG. 1). The overcap 24 is removably coupled to the container 22 about the chime 30 such that the drip bead 90 projects into the container 22. More particularly, the chime 30 is received within the channel 110 (FIG. 3B) defined by the overcap 24. The skirt 60 extends along an exterior of the container 22, with the clip(s) 62 nesting against a bottom of the chime 30. In this position, the interior surface 100 of the shoulder 50 bears against the chime 30. The drip bead 90 and a portion of the interior surface 64 of the skirt 60 may also contact the chime 30. In a preferred embodiment, the channel 110 is a continuous annular channel, with the drip bead 90 projecting over the chime 30 in forming a guide surface from an interior of the overcap 24 to an interior of the container 22 and a barrier to the passage of liquids between the overcap 24/container 22 interface.

In particular, during microwave heating (i.e., with the lid 32 (FIG. 1) removed and the overcap 24 assembled to the container 22), an established consumer preference is to at times heat the consumable item 38 (FIG. 2) until boiling is achieved. During heating of the consumable item 38, moisture in the form of steam expands in the container 22 and naturally increases the pressure inside the container 22/overcap 24 assembly. To this end, the headspace H is provided to permit the steam/consumable item 38 to expand slightly, while the vents 82 permit the steam to escape through the overcap 24. In this way, an equalization of pressure between the container 22/overcap 24 and the atmosphere is achieved.

When boiling is achieved, the consumable item 38 (FIG. 2) will bubble and expand into a portion of the headspace H (FIG. 3A). In so doing, the consumable item 38 will splatter and/or condense across an interior of the overcap 24 (e.g., at or along the panel 80 and/or the neck 70). The annular drip bead 90 directs dripping (e.g., induced by gravity) of at least a portion of this accumulated consumable item 38 from the panel 80 and/or the neck 70 back into the container 22. Specifically, the drip bead 90 projects below a topmost portion of the chime 30 by the distance D (FIG. 3) such that the consumable item 38 accumulated along an interior of the overcap 24 (especially at or near the neck 70), as it falls under the action of gravity, is directed along the drip bead 90 and returned to the container 22 (it being understood that spattered and/or condensed consumable item 38 at a central portion of the panel 80 may not necessarily flow or progress to the neck 70, but instead will remain on the panel 80 and/or simply drip directly back into the container 22 via gravity). In this manner, the boiling consumable item 38 is consistently contained within the container 22/overcap 24 such that seeping or dripping of the consumable item 38 to an exterior of the container 22 is minimized and/or eliminated. Thus, the mess and potential handling inconveniences associated with conventional microwaveable packaging is eliminated.

Figure 5:
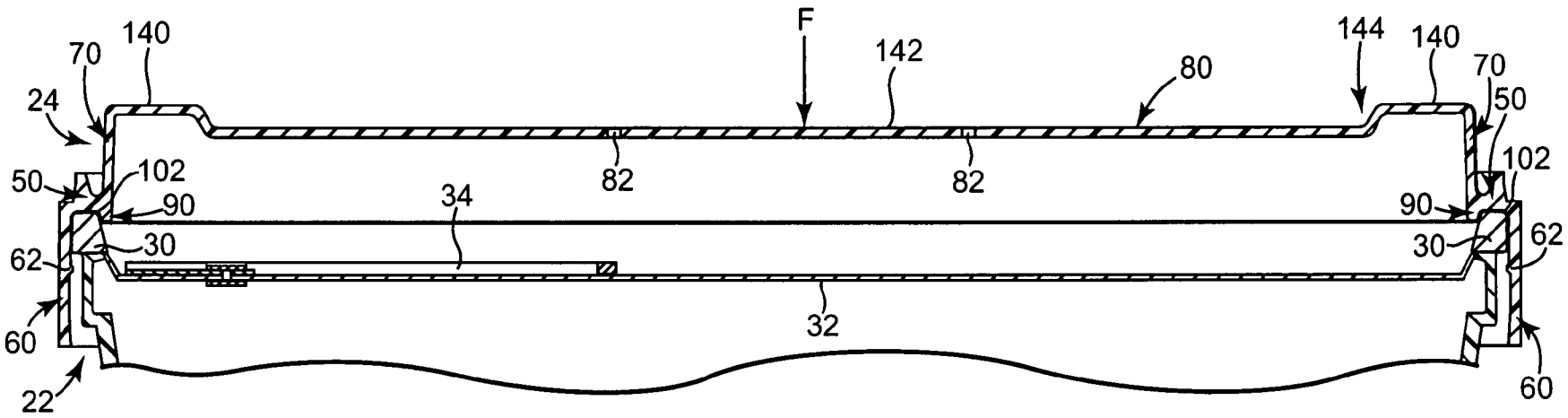
FIG. 5 is a cross-sectional view illustrating axial forces applied to the overcap and container of FIG. 4.

Another aspect of the overcap 24 relates to enhanced structural integrity during normal shipping activities as best described with reference to FIGS. 1 and 5. During distribution, several packaged good articles 20 are typically packaged into a carton or tray, and multiple trays will be stacked onto a pallet. In this regard, the bottommost packaged good articles 20 will bear the weight of the trays/packaged good articles (not shown) above them, represented by force F being applied to the panel 80 (with the force F increasing with a greater number of stacked articles 20/trays). Where each tray consists of a single "layer" of packaged good articles 20, the force F placed on the top panel 80 by a tray(s) on top of the tray in which the packaged good article 20 resides will be focused on the annular flange 140. Conversely, where one packaged good article (not shown) is stacked on a second article 20, the base (not shown) of the upper container (not shown) contacts the central portion 142 of the overcap 24 of the bottom article 20 and is maintained within the stacking recess 144. Thus, under these circumstances, the force F will be focused upon the central portion 142. Regardless, the loading incident upon the overcap 24 of any one individual packaged good article 20 can be significant. In application, for example during distribution, where multiple trays of packaged good articles 20 are stacked vertically, the loading force F onto an individual overcap 24 at the bottom of the stacked packaged good articles 20 can exceed 50 pounds.

With the above in mind, the overcap 24 is capable of withstanding relatively large loading forces F and can resist deformation that would otherwise damage the known, prior overcaps. In particular, when the overcap 24 is assembled to the container 22, the chime 30 is received within the channel 110 (FIG. 3B). To this end, the shoulder 50 and drip bead 90 each contact the chime 30. Thus, the chime 30 supports the neck 70 (via contact with the drip bead 90 and the shoulder 50), and the neck 70 in turn supports the force F applied to the panel 80. The neck 70 is thus a most likely failure point for at least two reasons. First, if the neck 70 were to overtly laterally expand or deflect in response to the force F, the shoulder 50 may lose contact with the chime 30, causing the entire overcap 24 to slide downwardly onto the container 22. Second, the neck 70 may buckle in response to the force F. The overcap 24 of the present invention is uniquely configured to overcome these concerns.

First, when the chime 30 is nested within the channel 110 (FIG. 3), the drip bead 90 bears against an interior surface of the chime 30. This relationship resists lateral or radially outward deflection of the neck 70 relative to the chime 30. In particular, the drip bead 90 effectively locks against the chime 30 in response to a lateral component of the force F being translated through the neck 70. Along these same lines, the neck 70, in one embodiment, is oriented at an approximately 90-degree angle (i.e., the nesting angle N of FIG. 3B) relative to the shoulder (e.g., 91-95 degrees) and at an approximately 90-degree angle relative to the panel 80 (e.g., 91-95 degrees). This relationship dictates that the force F is translated through the neck 70 in a substantially perpendicular manner relative to the shoulder 50/chime 30 interface, thereby minimizing a lateral or radially outward component of the force F across the neck 70.

In addition, in one embodiment, the shoulder 50 is relatively thick in cross-section (especially as compared to prior art microwaveable overcaps) as previously described. This increased thickness enhances a stiffness of the neck 70, thus supporting the neck 70 against possible buckling in response to the force F.

It has been surprisingly discovered that the overcap 24 of the present invention coupled to the container 22 can maintain its structural integrity in the presence of an axial force F in excess of approximately 50 pounds. It has been found that known prior art overcaps exhibit irreversible damage under similar conditions. Notably, the enhanced integrity of the overcap 24 is achieved while minimizing a thickness of the neck 70 (and thus optimizing material costs) for example, on the order of 0.020-0.030 inch. The neck 70 can have other shapes that further heighten a stiffness of the neck 70.

Figure 6:
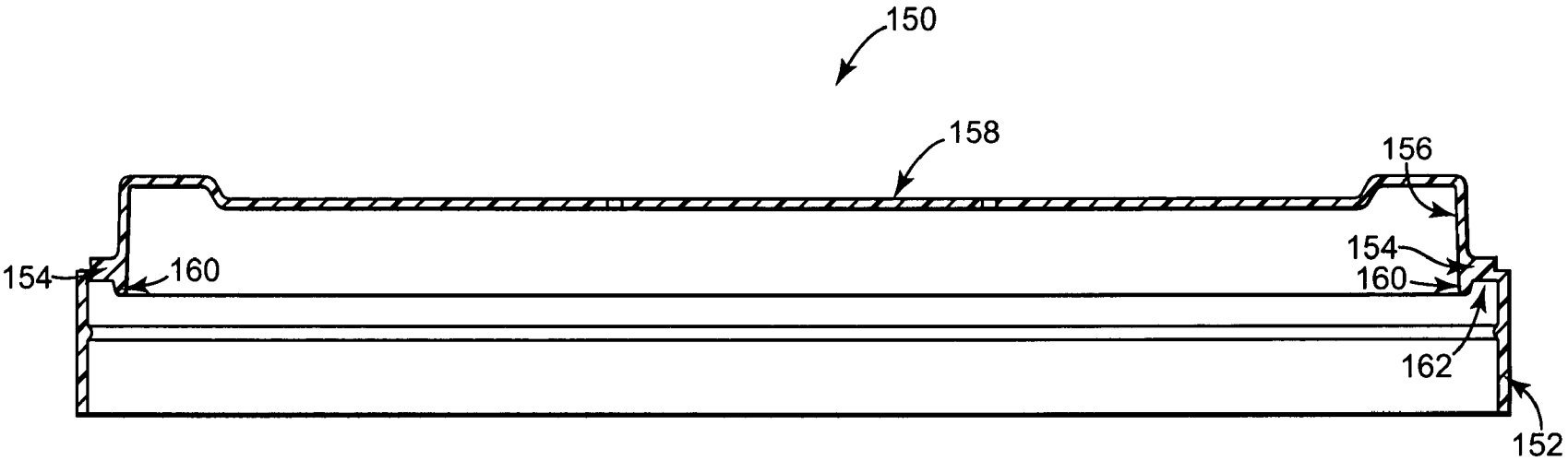
FIG. 6 is a cross-sectional view of another embodiment overcap in accordance with principles of the present invention.

Further, in other alternative embodiments, a thickness of the shoulder 50/transition segment 52 can be further increased (as compared to disclosed embodiments) to enhance overall rigidity. For example, FIG. 6 illustrates an alternative embodiment overcap 150. The overcap 150 is similar to the overcap 24 (FIG. 3A) previously described, and includes a skirt 152, a shoulder 154, a neck 156, and a panel 158. The neck 156 and/or shoulder 154 forms a downwardly projecting drip bead 160 as part of a channel 162. As compared with the overcap 24 previously described, the overcap 150 of FIG. 6 forms the shoulder 154 to have a relatively uniform thickness, on the order of at least 0.05 inch, more preferably approximately 0.07 inch. This elevated thickness provides increased structural rigidity/support to the neck 156 for the reasons described above.

The microwaveable packaged good article, and in particular the overcap, of the present invention provides a marked improvement over previous designs. The unsightly, and possibly dangerous, problems associated with undesired product drippage along an exterior of the container is virtually eliminated. Further, the overcap of the present invention is highly robust and maintains its structural integrity under the rigors of most packaging/distribution conditions.

Although specific embodiments have been illustrated and described, it will be appreciated by those of ordinary skill in the art that a variety of alternate and/or equivalent implementations may be substituted for the specific overcap embodiments shown and described without departing from the scope of the present invention. This application is intended to cover any adaptations or variations of overcaps for microwaveable packaged good articles. Therefore, it is intended that this invention be limited only by the claims and the equivalents thereof.

What is claimed is:

1. A microwaveable packaged good article comprising:
a container including:
a base,
a continuous wall extending from the base and terminating in a chime; and
an overcap removably coupled to the container and including:
a panel,
a neck extending from the panel and terminating in a drip bead defining a leading end and an interior surface, the leading end established opposite the panel,
a skirt radially spaced from the drip bead to define a channel between the skirt and the interior surface of the drip bead;
wherein the chime is received within the channel, the leading end of the drip bead is free of contact with the chime, and the panel is outside of the container upon assembly of the overcap to the container.

2. The microwaveable packaged good article of claim 1, wherein upon assembly, the drip bead extends below the chime into the container.

3. The microwaveable packaged good article of claim 1, wherein the channel is a continuous channel that upon assembly is coupled to an entirety of a circumference of the chime.

4. The microwaveable packaged good article of claim 1, wherein upon assembly, the drip bead forms a barrier to the passage of liquid between the container and the skirt.

5. The microwaveable packaged good article of claim 1, wherein the chime defines a top surface, an interior surface, and an exterior surface, and further wherein upon final assembly, the drip bead contacts the interior surface, and the skirt contacts the exterior surface.

6. The microwaveable packaged good article of claim 1, further comprising:
a shoulder radially spacing the skirt from the drip bead.

7. The microwaveable packaged good article of claim 6, wherein the chime defines a top surface, an interior surface, and an exterior surface, and further wherein upon assembly, the shoulder contacts the top surface.

8. The microwaveable packaged good article of claim 7, wherein the shoulder has a thickness of at least 0.035 inch.

9. The microwaveable packaged good article of claim 1, further comprising:
a removable lid secured to the chime.

10. The microwaveable packaged good article of claim 1, further comprising:
a consumable item contained in the container.

11. The microwaveable packaged good article of claim 10, wherein the consumable item is selected from the group consisting of soup, chili, stew, pasta meal, and pork-and-beans.

12. A method of microwave heating a packaged good article comprising:
providing a container containing a consumable item;
securing an overcap to the container, the overcap including:
a panel,
a neck extending from the panel and terminating in a drip bead,
a skirt radially spaced from the drip bead by a shoulder to define a channel received over a chime of the container, the skirt extending from an intermediate location along the neck,
wherein securing the overcap includes an assembled vertical position of the overcap relative to the chime being solely dictated by an abutting interface between the shoulder and the chime;
microwave heating the packaged good article to boil the consumable item such that a portion of the consumable item accumulates on an interior of the overcap; and
directing at least a portion of the accumulated consumable item along the drip bead and back into the container.

13. The microwaveable packaged good article of claim 1, wherein the base, the continuous wall, and the chime combine to define a containment volume, and further wherein the panel is located outside of the containment volume opposite the base upon final assembly.

14. The microwaveable packaged good article of claim 1, wherein relative to an upright orientation in which the chime is above the base, the panel is above the chime upon final assembly.

15. The microwaveable packaged good article of claim 1, wherein the skirt extends from an intermediate location along the neck.

16. The microwaveable packaged good article of claim 1, wherein the neck is a continuous ring that, relative to an upright orientation of the overcap, defines a lower-most edge at the leading end and an upper-most edge opposite the lower-most edge, and further wherein the panel intersects the upper-most edge and the skirt intersects the neck at a location between the upper-most and lower-most edges.

17. The method of claim 12, wherein the container further includes a base and a continuous wall extending from the base and terminating in the chime, and further wherein the base, the wall, and the chime combine to define a containment volume, and even further wherein the step of securing the overcap to the container includes maintaining the panel beyond the containment volume in a direction opposite the base.

18. The method of claim 17, wherein relative to an upright orientation in which the chime is above the base, the step of securing the overcap to the container includes maintaining the panel above the chime.

19. The method of claim 12, wherein the panel is longitudinally spaced from the channel.

20. The method of claim 12, wherein the neck terminates in a top end opposite the drip bead, and further wherein the panel intersects the top end.

* * * * *